US008453576B2

(12) United States Patent
Roodenburg et al.

(10) Patent No.: US 8,453,576 B2
(45) Date of Patent: Jun. 4, 2013

(54) ROLLERCOASTER AMUSEMENT DEVICE

(75) Inventors: Joop Roodenburg, Delft (NL); Petrus Joseph Hubertus Clerx, Roermond (NL)

(73) Assignee: Vekoma Rides Engineering B.V., Vlodrop (NL)

( * ) Notice: Subject to any disclaimer, the term of this patent is extended or adjusted under 35 U.S.C. 154(b) by 375 days.

(21) Appl. No.: 12/673,410

(22) PCT Filed: Aug. 18, 2008

(86) PCT No.: PCT/NL2008/000192

§ 371 (c)(1),
(2), (4) Date: Oct. 8, 2010

(87) PCT Pub. No.: WO2009/022905

PCT Pub. Date: Feb. 19, 2009

(65) Prior Publication Data

US 2011/0048274 A1 Mar. 3, 2011

(30) Foreign Application Priority Data

Aug. 16, 2007 (WO) ..... PCT/NL2007/000200

(51) Int. Cl.

| | |
|---|---|
| ***A63G 1/00*** | (2006.01) |
| ***B61B 3/00*** | (2006.01) |
| ***A47C 31/00*** | (2006.01) |

(52) U.S. Cl.

USPC ..... 104/53; 104/63; 105/148; 297/466

(58) Field of Classification Search

USPC ..... 104/53, 62–64, 74–76, 82, 85; 105/148, 105/149.1, 149.2; 297/466, 484, 486

See application file for complete search history.

(56) References Cited

U.S. PATENT DOCUMENTS

| | | | |
|---|---|---|---|
| 4,531,459 | A | 7/1985 | Yamada |
| 2002/0070599 | A1 | 6/2002 | Berra |

FOREIGN PATENT DOCUMENTS

| | | | | |
|---|---|---|---|---|
| EP | 1 201 280 | A2 | | 5/2002 |
| EP | 1 215 091 | A2 | | 6/2002 |
| WO | WO-96/22821 | A1 | | 8/1996 |
| WO | 97/02878 | A1 | | 1/1997 |
| WO | WO-99/22830 | A1 | | 5/1999 |
| WO | WO-2004/035164 | A1 | | 4/2004 |
| WO | WO-2004/073818 | A1 | | 9/2004 |
| WO | WO2004073818 | | * | 9/2004 |
| WO | WO-2007/004904 | A1 | | 1/2007 |

* cited by examiner

*Primary Examiner* — R.J. McCarry, Jr.

(74) *Attorney, Agent, or Firm* — Birch, Stewart, Kolasch & Birch, LLP

(57) ABSTRACT

A roller coaster amusement device adapted to provide for the passengers a ride wherein the passengers experience at least a portion of the ride in a racing position, the amusement device wherein an endless guide structure at least including multiple curves, one or more carriages displaceable along the guide structure, a passenger assembly associated with a carriage, said passenger assembly being adapted to accommodate at least one passenger such that said passenger experiences at least a portion of the ride in a racing position, a station along said guide structure allowing the passenger to board the passenger assembly.

37 Claims, 8 Drawing Sheets

ROLLERCOASTER AMUSEMENT DEVICE

Figure 1:
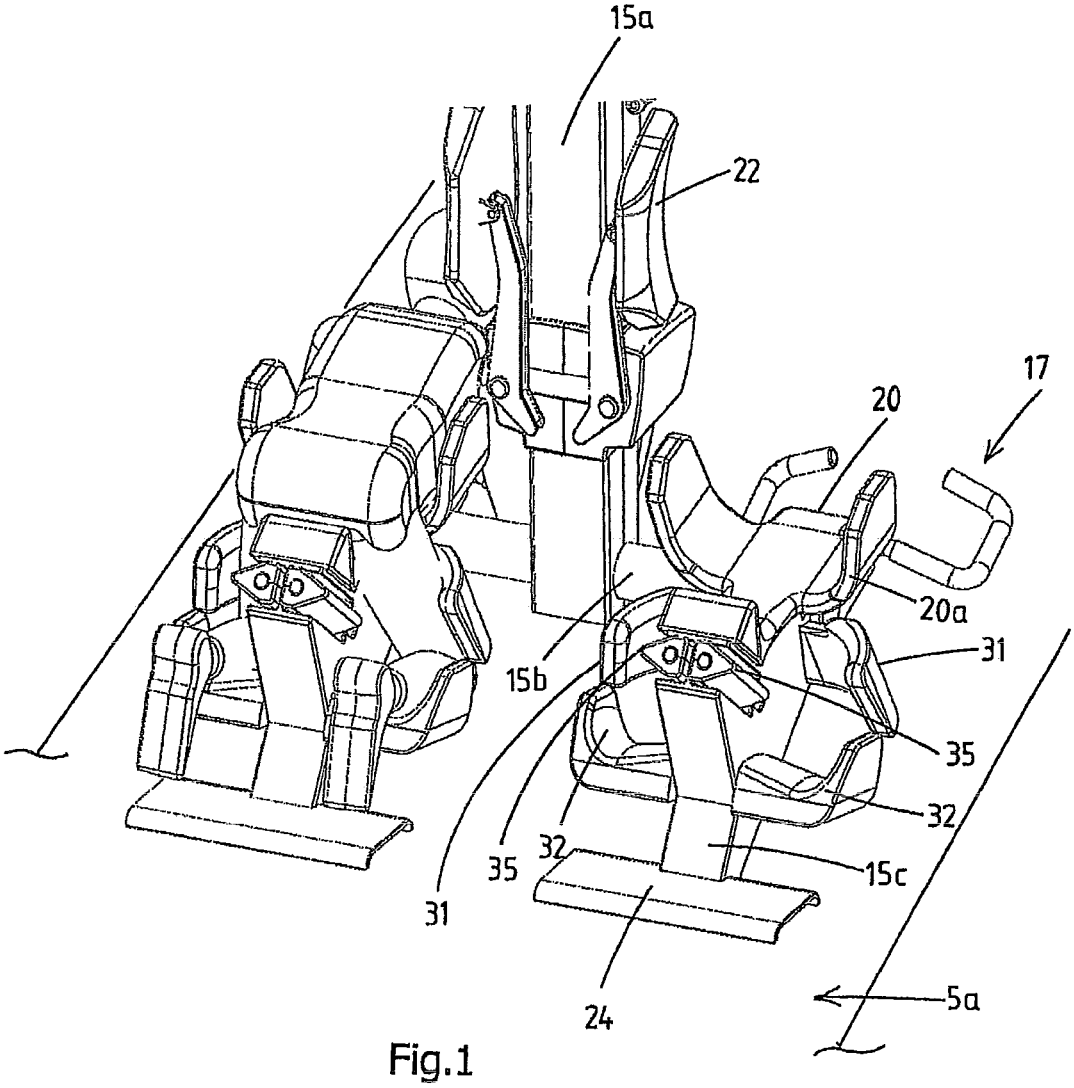

The present invention relates to the field of rollercoaster amusement devices which comprise an endless guide structure with multiple curves and a station along said guide structure allowing passengers to board and/or to disembark the rollercoaster amusement device. The device further includes one or more carriages that are displaceable along said guide structure. A passenger assembly is associated with such a carriage, the passenger assembly being adapted to accommodate at least one passenger.

Nowadays several rollercoasters are in operation wherein the passengers are accommodated and restrained in a "racing position" during the ride. In said racing position the passengers head is directed forward and the passenger's trunk is resting with its chest side on top of a chest support. A back restraining member restrains motion of the passenger away from the chest support, whereas a leg restraining device holds each leg such that the upper leg is angled downward with respect to the trunk and the lower leg is angled rearward with respect to the upper leg.

In WO2004/073818 (Vekoma) an example of a rollercoaster with passengers in racing position is shown. This rollercoaster, known as the Vekoma Motorbike Coaster, is nowadays operational in the Toverland amusement park located in Sevenum, Limburg, 5975 MS Netherlands.

Vekoma also has manufactured rollercoasters according to the design of WO99/22830, wherein the passengers board the rollercoaster in a normal seated position, are restrained while in said seated position, and are then brought into a flying position, suspended below the guide structure. The position of the passengers during the ride corresponds to the racing position.

Also Bolliger & Mabillard have designed a suspended rollercoaster wherein the passengers are accommodated in a racing position. This rollercoaster is known as the Bolliger & Mabillard Flying Coaster and is e.g. in operation now as the Superman—Ultimate Flight coaster in the Six Flags Great America Park located in Gurnee, Ill. 60031 USA.

A problem associated with the racing position lies in the area of restraining of the legs of the passenger in the racing position.

In WO2004/073818 the leg restraining device includes foot rest as well as a slidable member having on each side thereof an upper leg retention member. Upon boarding the passenger sits down on the saddle, places his feet in the foot rests and then slides the slidable member towards him, thereby engaging the upper leg retention members with the upper legs. The back restraining members is also actuated by sliding said slidable member, thereby holding the trunk on the chest support.

In practice this WO 2004/073818 leg straining device allows accommodation and restraining of passengers having a minimum height of 1.40 metres. This excludes young children for taking this rollercoaster.

In WO 99/22830 it is disclosed that the passenger's legs are restrained by a knee securing part, which comes to lie against the front of the passenger's knees while the front end of the seat cushion is present at the back of the passenger's knees. The knee securing part is hinged at its lower end about a pivot which is mounted on a platform below the passenger's feet. Upon boarding the seat is in a normal position (as a chair), so that the passenger can sit down and then the knee securing part is brought into its restraining position. The carrier and guide structure are designed such that upon departure from the boarding station the position of the seat with the passenger is changed such that the passenger becomes suspended below the guide structure in a racing position. In order to effect the change of position quite complex technical measures are required. This leads to substantial costs in view of purchasing and operation of the rollercoaster.

The Bolliger & Mabillard coaster is construed with a tilting passenger assembly with a seat for each passenger. In a vertical boarding/disembarking position of the passenger assembly the passenger can sit down on the seat, which has a backrest and a seat cushion member. The backrest and the seat cushion of the seat are supported by a frame member which has at the side of the front edge of the seat cushion an extension, which is situated between the legs of the seated passenger. This extension is provided with lower leg retention members that are each adapted to extend behind the lower leg. The extension is also provided with pivotal flaps which are pivotal between an access position and a restraining position wherein the lower legs are each encircled by the combination of the lower leg member and the pivotal flap. This arrangement is disclosed in detail in EP 1 215 091.

Just as the WO 99/22830 a drawback of this B&M roller coaster is that the change of position of the passenger between the seated position upon boarding and the suspended position during the ride requires quite complex technical measures. In addition the restraining of the legs is unsuitable for small children, as they can wiggle their legs from the leg restraining devices.

The first aspect of the invention aims to provide an improved rollercoaster amusement device, in particular with regard to the structure of the device and the restraining of the legs in the racing position.

The first aspect of the invention achieves this object by providing a rollercoaster amusement device according to the present invention.

In this device the passenger will place his legs with bent knees in the leg retention members and then the knee restraining member is moved so as to restrain the legs, preventing the passenger from freeing his legs from said configuration. This provides safety for the passengers of the rollercoaster. Also it has been found that this solution—when suitably dimensioned—allows to accept smaller children, e.g. of a minimum height of 1.20 metres, as passengers in the rollercoaster.

The knee restraining member is operated by an associated drive (e.g. an electronic drive, a pneumatic drive, a mechanical transmission, etc).

As the passenger enters the passenger assembly with their leg bend, basically in a kneeling fashion, the device requires no change of position of the passenger as described with referral to the WO 99/22830 and EP 1 215 091 designs. This allows a quite simple and cost efficient design of the passenger assembly.

According to the invention, at least one of the lower leg retention members may be arranged substantially stationary on the frame.

It can be envisaged to have some mobility of the leg retention members, e.g. tiltable and/or spring mounted to accommodate for different diameter legs, especially thighs, of the passengers.

According to a preferred embodiment, at least one lower leg retention member is connected pivotable about a pivot axis to the frame. This pivot axis is provided intermediate each lower leg retention member, dividing the lower leg retention members in an upper portion and a lower portion, and the connection of the pivot axis to the frame is arranged below and behind the position of the knee in the racing position.

This arrangement of lower leg retention member and pivot axis is such that the passenger upon boarding places the upper leg against the upper leg retention member, engages with the lower leg retention members, preferably with the upper portion thereof, and should bend his legs at the knee and pivot the pivotable lower leg retention member to the racing position. This occurs automatically upon boarding: the only way the passenger fits in the passenger assembly is by bending his knee, which when the upper leg is placed against the upper leg retention member results in a pivoting movement of the lower leg, which inevitably pivots the lower leg retention member. As such, when the passenger has boarded, the assembly is in the racing position, including the lower leg retention member. Hence, the device requires no change of position of the passenger after having boarded the passenger assembly. Either one, or both lower leg retention members may be provided pivotable. It is conceivable to provide one substantially stationary lower leg retention member and one pivotable lower leg retention member.

Preferably, the lower leg retention members are at least pivotable between a substantially vertical position and a pivoted position, which pivoted position corresponds to the racing position in which the lower leg, restrained in the lower leg retention member, is angled rearward with respect to the upper leg.

In a preferred embodiment, the lower leg retention members comprise at least two padded portions between which at least one step is provided, which step is accessible in a substantially vertical access position. Preferably, the step is provided near the pivot axis. A step is beneficial for small passengers, who cannot reach the saddle without help: either by being lifted up, or by using an additional step, which may for example be the substantially stationary lower leg retention member. It is more beneficial, in particular for the lifetime of the lower leg retention member, to provide a step for the smaller passengers. Providing this step in the pivotable lower leg retention members is a very elegant solution, as no additional components are required. It is conceivable to provide a single pivotable lower leg retention member only at the entry side of the passenger assembly, and a stationary lower leg retention member at the other side.

In an even more preferred embodiment, a spring is provided to position the lower leg retention members in the substantially vertical access position. This is beneficial as when the passengers arrive at the rollercoaster amusement device, they will recognise the additional step immediately, without having to tilt the lower leg retention members. Passengers have to overcome this spring force upon pivoting the lower leg retention member during boarding. Another benefit is that the pivotable lower leg retention member cannot pivot away from the passenger's lower leg, which may occur when small passengers only engage with the upper portion of the lower leg retention member. It is also conceivable, in particular for these small passengers, to provide a locking mechanism at the pivotable lower leg retention member or at the frame to fixate the position of the lower leg retention member after the passengers have boarded the passenger assembly.

Further advantageous embodiments are described in the subclaims.

A second aspect of the present invention relates to a rollercoaster amusement device wherein the passenger assembly is adapted to accommodate two passengers in a side-by-side arrangement.

WO 2004/073818 discloses a rollercoaster with carriages that each accommodate two passengers in a side-by-side arrangement, wherein each passenger is in a racing position during the ride.

The second aspect of the present invention aims to provide an enhance sense of excitement for the passengers, albeit with a rather uncomplicated construction of the rollercoaster amusement device. As outlined above Bollinger & Mabillard do market a suspended flying coaster, however with a complicated and expensive construction.

The second aspect of the present invention provides for a rollercoaster amusement device according to claim 20. The suspended portion of the passenger assembly is of simple structural design, which allows to market the rollercoaster as a more economical "family coaster" compared to generally costly "thrill rides".

Preferably the suspended portion can swing in pendulum fashion, unlike the previously mentioned B&M coaster, to increase the excitement for the passengers.

Further preferred constructional features are mentioned in the subclaims.

The skilled person will appreciate that both aspects of the invention can be used separately or in combination.

Figure 2:
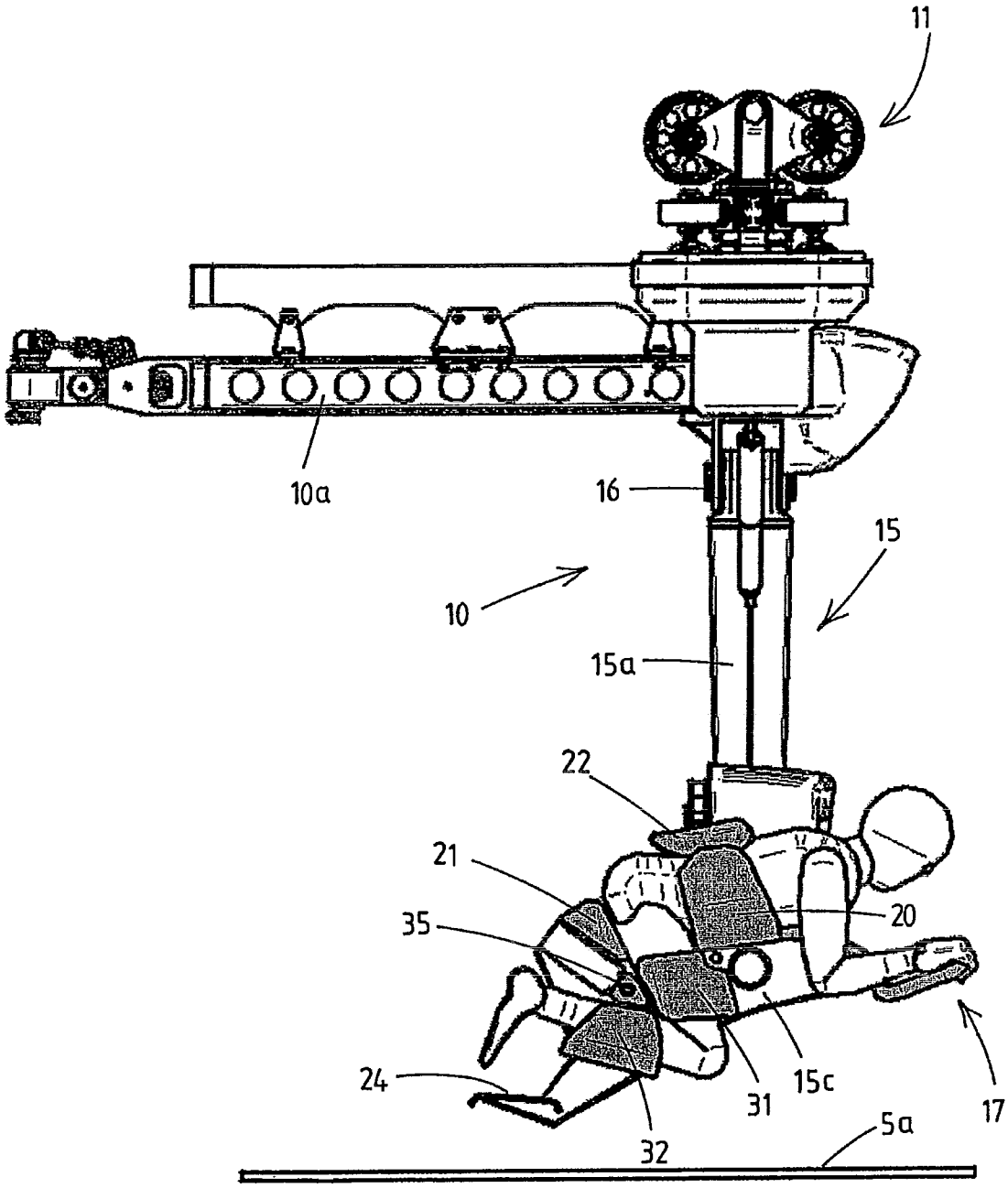
Figure 3:
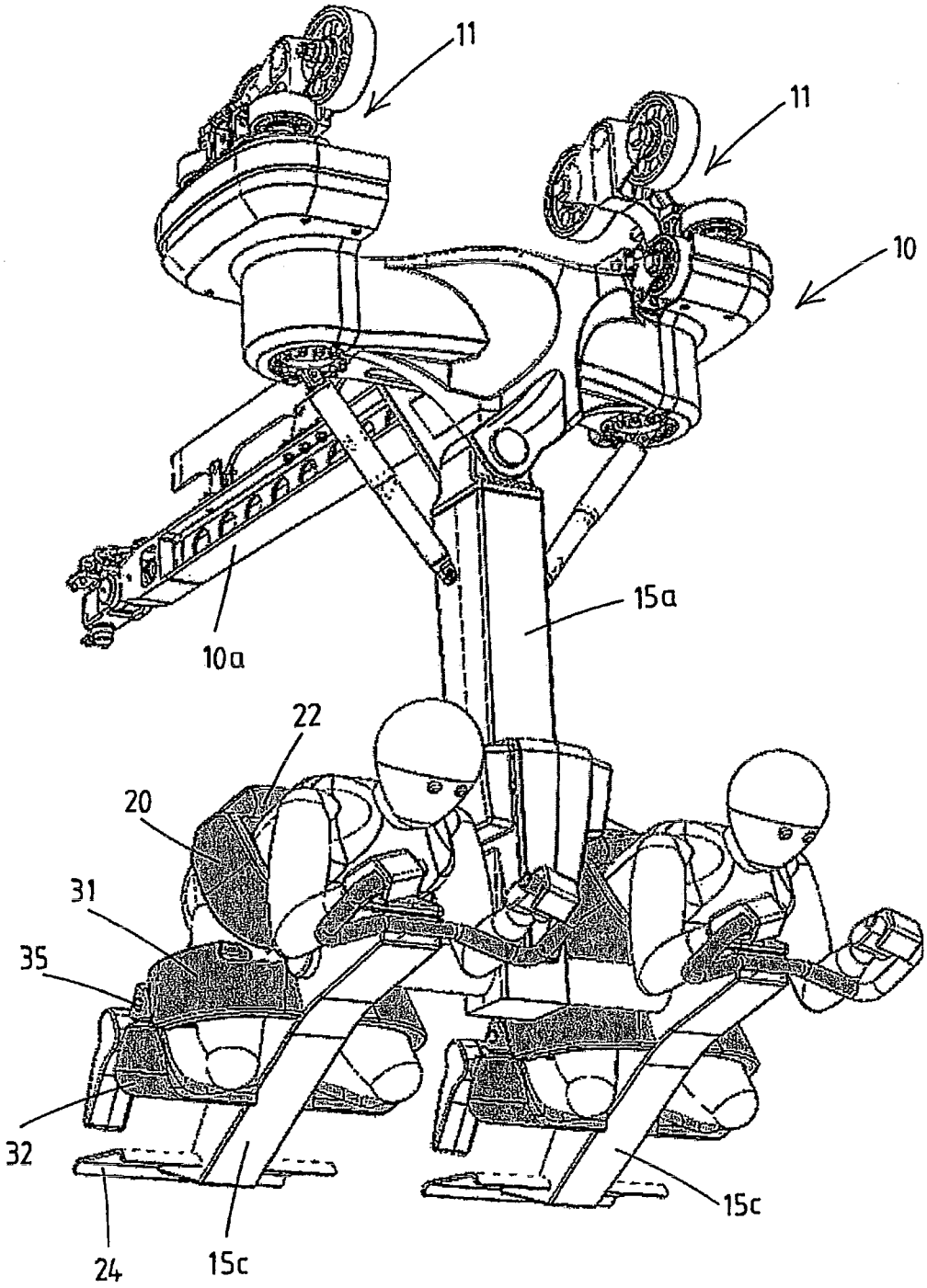
Figure 4:
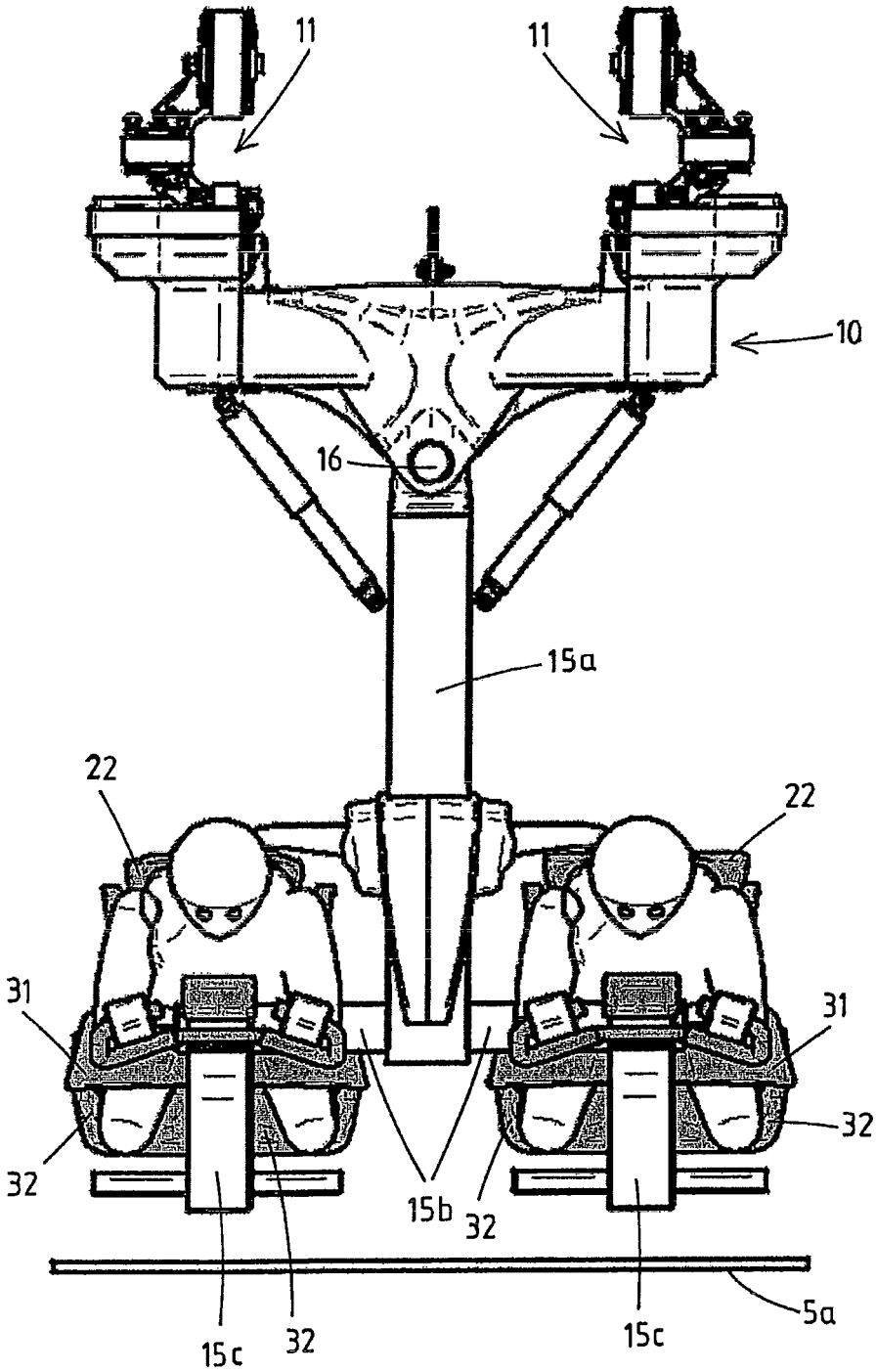
Figure 5:
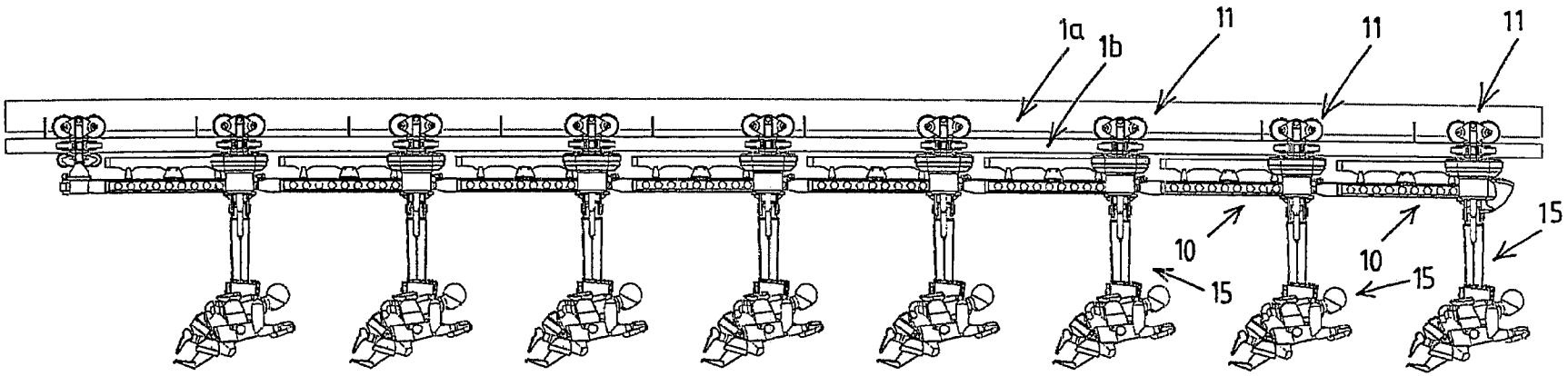
Figure 6:
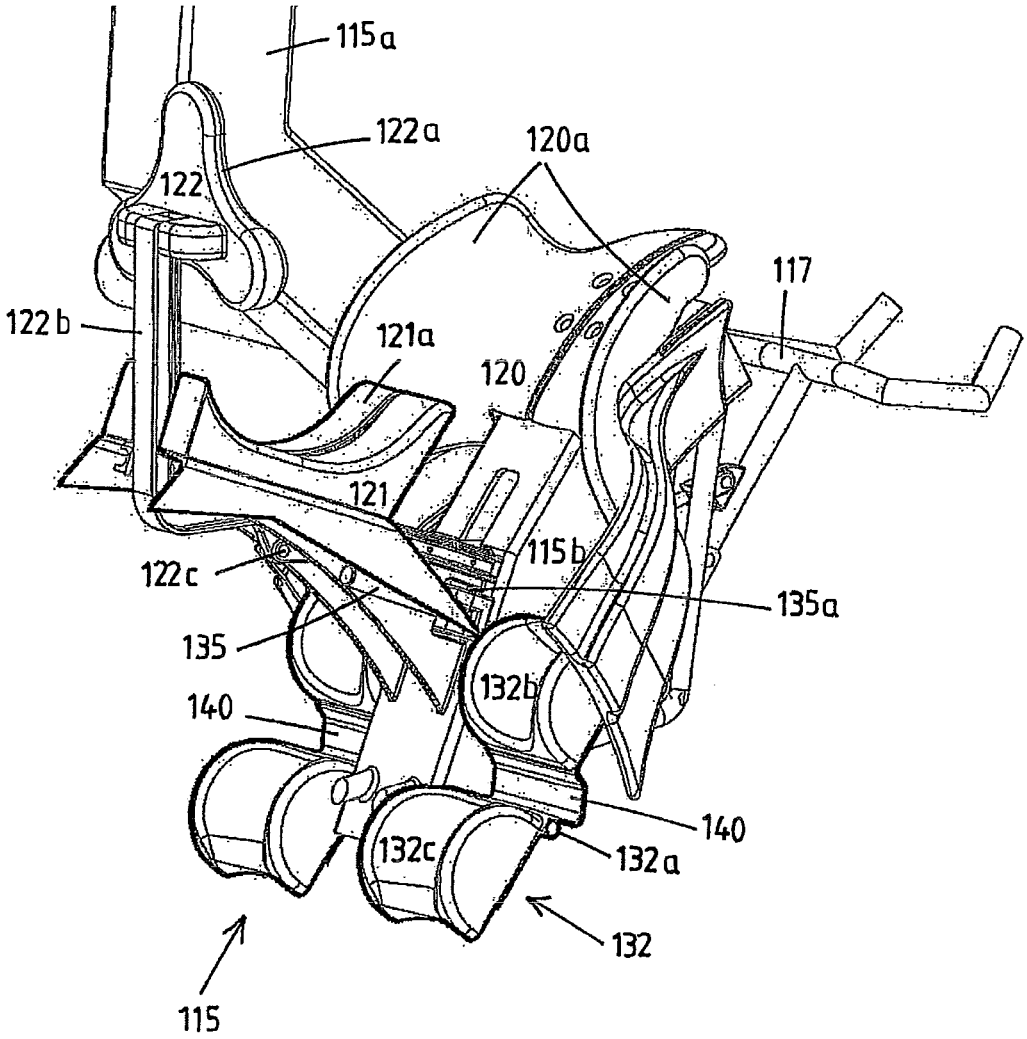
Figure 7:
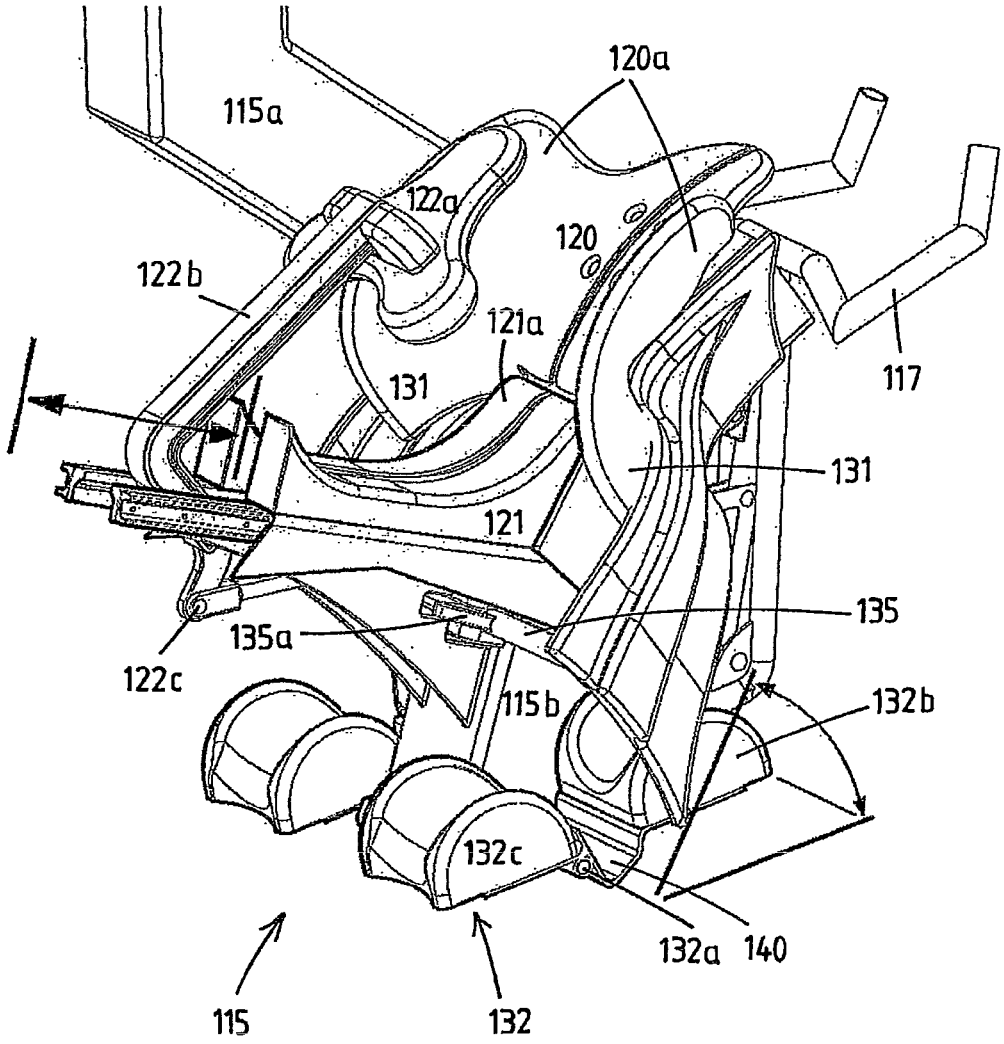
Figure 8:
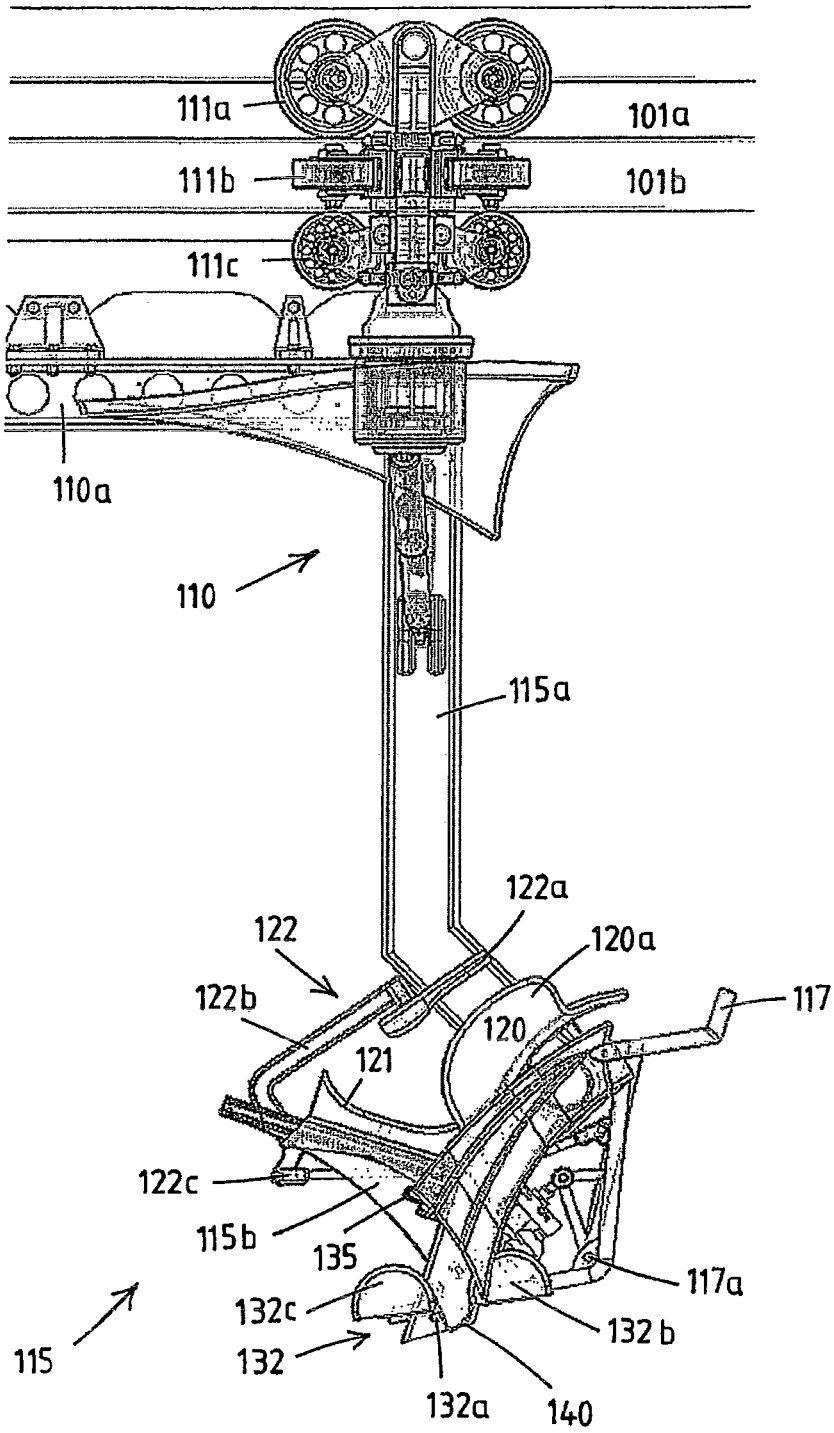

The aspects of the invention will now be described in more detail referring to the appended drawings. In the drawings:

FIG. 1 shows a perspective view of a portion of an example of a rollercoaster amusement device according to the invention, FIG. 2 shows a carriage and passenger assembly of the device of FIG. 1 in elevational view, FIG. 3 the carriage and passenger assembly of FIG. 2 in perspective view, FIG. 4 the carriage and passenger assembly of FIG. 2 in frontal view, FIG. 5 a portion of the guide structure and a train of carriages of the device of FIG. 1, FIG. 6 shows a perspective view of an alternative example of a passenger assembly for a rollercoaster amusement device according to the invention prior to boarding of the passenger, FIG. 7 shows the passenger assembly of FIG. 6 in the racing position, FIG. 8 shows in a side view a portion of a rollercoaster amusement device according to the invention comprising the passenger assembly of FIGS. 6 and 7.

Referring to the FIGS. 1-5 an example of a rollercoaster amusement device according to the invention will be explained in detail.

FIG. 5 shows a portion of an endless guide structure, commonly referred to as the track, here having a main beam 1*a* and two parallel rails 1*b* (here tubular). The guide structure comprises multiple curves, and possibly also banking portion(s), sloping section(s) (uphill/downhill), etc.

A train of carriages 10 is provided which are displaceable along said guide structure 1*a, b*. Here each carriage 10 has two wheel sets 11 with wheels, each wheel of the set engaging a rail 1*b*. Each carriage 10 has a longitudinal member 10*a* extending rearwards along the guide structure 1*a, b* and having a coupling for coupling to another such carriage 10 as is known in the art.

Associated with each carriage 10 is a passenger assembly 15, here for two passengers in a side-by-side arrangement. Each passenger assembly 15 is adapted to provide for the passengers a ride in a racing position.

A boarding station (of which only a floor 5*a* is shown in the figures) is provided along the guide structure 1*a, b*. This station could solely serve the purpose of boarding of the passengers while another, disembarking station serves for disembarking of the passengers. As is known in the art, a single station could be configured to serve both purposes.

Each passenger assembly 15 includes a frame that is connected to the carriage. In this example, as is preferred, it is envisaged that the frame has a suspension arm 15*a* which is suspended from the carriage 11. The frame further has a lateral spreader beams 15*b* mounted on said suspension arm

15*a* and each extending laterally from said suspension arm 15*a* in opposite directions, each lateral spreader beam 15*b* supporting a central frame structure 15*c*.

The suspension arm 15*a* is suspended from the carriage 11 by means of a pivot 16, said pivot 16 having a pivot axis essentially in longitudinal direction of the guide structure 1*a,b*, such that the passenger assembly 15 will swing in pendulum fashion as the carriage 11 passes through a curve of the guide structure 1*a,b*.

As can be seen in the figures for each passenger position the frame has a central frame structure 15*c*. On the topside of this central frame structure a chest support 20 is mounted in a stationary position, such that the passenger can rest the front of his trunk on the chest support 20. In this example the chest support is U-shaped so as to have side flaps 20*a* at opposite sides of the trunk.

Rearward of the chest support 20 the central frame structure is provided with a saddle 21, as a motorbike, upon which the passenger can be seated.

In front of the chest support 20 the central frame structure 15*a* is provided with a handlebar assembly 17, which the passenger can grip with both hands. Here the handlebar assembly 17 also allows the passenger to rest his underarms on top of the handlebar assembly.

As can be seen, and is preferred, the passenger has clear sight both in downward, forward and side directions during the ride. No headrest is provided here, as is preferred, to allow for maximum freedom of the head.

A back restraining member 22 is provided to restrain motion of the passenger away from the chest support 20. Here, as is preferred, each back restraining member 22 is mounted mobile on the suspension arm 15*a*, so as to be movable (here pivotable) between an access position allowing the passenger, at the boarding station, to place his chest on the chest support 20 (see FIG. 1), and a restraining position, wherein the passengers trunk is restrained (see FIG. 2-5). Preferably an associated drive is provided, e.g. a pneumatic or electric drive (not shown).

Freedom of the head is enhanced by the design of back restraining member 22, which is adapted to engage on the back of the passenger so as to leave the shoulder portion of the passenger free, thus allowing the passenger to move, e.g. raise its shoulder portion and head.

For such rollercoaster it is consider relevant to securely restrain each leg of the passenger, so that during the ride the passenger will not be able to extend his leg in a dangerous manner, e.g. sideways.

In the design shown here a leg restraining device is provided for each leg of the passenger. Each device here includes an upper leg retention member 31 and lower leg retention member 32 which are arranged stationary on a side the central frame structure 15*c*. So the central frame structure 15*c* here has a portion which extends between the legs of the passenger.

These members 31, 32 are arranged such that when the passenger is accommodated with its chest against the chest support 20, each leg is oriented such that the upper leg is angled downward with respect to the trunk and the leg is bend at the knee so that the lower leg is angled rearward with respect to the upper leg.

As can be inferred from the figures, in particular FIG. 1, upon boarding the passenger assembly the passenger should bend his legs at the knee and place the upper and lower leg against the upper and lower leg retention members 31, 32. This can be done while being seated on the saddle 21, but it can also be envisaged that the passenger (e.g. from a position standing on the foot platform 24) kneels down and forward and so places his legs against the members 31, 32.

Each leg restraining device further includes a mobile knee restraining member 35 and an associated knee restraining member drive (not shown) for driving the knee restraining member 35.

This knee restraining member 35 is mobile between an access position—allowing the passenger, at the boarding station, to place his upper and lower legs against the upper and lower leg retention members—(see FIG. 1), and a restraining position (see FIGS. 2-5) wherein the knee restraining member is positioned at the backside of the knee so that the knee restraining member 35 prevents the passenger from removing the leg from the upper and lower leg retention members 31, 32.

In this example, as is preferred, the knee restraining member 35 is pivoted on the central frame structure 15*c*, here at a position behind the saddle 21.

As can be seen, and as is preferred, the upper and lower leg retention members 31, 32 leave open a space between them in which the knee of the passenger is accommodated. This is comfortable for the passenger.

Also it can be observed, as is preferred, that the upper and lower leg retention members 31, 32 each are L-shaped having an inner end connected to a central frame structure 15*c* of the passenger assembly, and each having a front section adapted to extend across the front of the respective leg part and each having an outer side section adapted to extend along the side of the respective leg part.

Here, as is preferred, the knee restraining member 35 is L-shaped having an inner end connected pivotally to the central frame structure 15*c*, and having a transverse section adapted to extend in transverse direction along the backside of the knee, and having an outer side section adapted to extend along the outside of the knee.

As can be observed, and is preferred, the outer side sections of the retention members 31,32 and of the knee retention member 35 meet to form to substantially closed circles around both the upper leg and the lower leg.

As can be seen the feet of the passenger are unrestrained here as is preferred.

In this example the suspension arm 15*a*, lateral spreader beams 15*b* and central frame structures 15*c* form a rigid constructional member which allows for an attractive cost price of the passenger assembly.

Here the trunk of the passenger is slightly upward inclined in the racing position, when considered with respect to the longitudinal axis of the guide structure 1*a, b*. In general for a rollercoaster of the type described here the chest support will be arranged in an orientation which lies between a position parallel to the guide structure and an upward inclined position of at most 40 degrees.

As is preferred—in the racing position—the upper leg is held in an orientation substantially at right angles to the guide structure between 20 degrees forward and rearward with respect to the normal to the guide structure.

As is also preferred—in the racing position—the lower leg is held in an orientation substantially parallel to the guide structure between 20 degrees upward and downward with respect to the guide structure.

As indicated in the introductory part the carriages and passenger assemblies could also be configured to be riding on top of the guide structure, e.g. similar to the WO 2004/073818 design, however with the inventive leg restraining devices. In this design each motorbike includes a central frame structure fastened on top of a carriage. Two of such motorbikes can be arranged side-by-side on a single carriage to obtain the experience that the passengers are racing against one another.

Referring to FIGS. 6-8 an alternative example of a passenger assembly 115 for a rollercoaster amusement device according to the invention will be explained in detail.

The passenger assembly 115 is suitable to be connected to a carriage 110 as shown in FIG. 8, to be displaceable along a guide structure of which a portion is visible in FIG. 8. The guide structure here comprises a main beam 101*a* and two parallel rails 101*b*.

A train of carriages 110 may be provided which are displaceable along said guide structure 101*a*, 101*b*. The shown carriage 110 has two wheel sets 111, comprising wheels 11*a*, 111*b* and 111*c* engaging a rail 101*b* on opposite sides of the track. Each carriage 110 has a longitudinal member 110*a* extending rearwards along the guide structure 101*a*, 101*b* and having a coupling for coupling to another such carriage 110.

The shown passenger assembly 115 is suitable of one passenger, but may alternatively be designed for two passengers in a side-by-side arrangement. The passenger assembly 115 is adapted to provide for the passengers a ride in a racing position, in this embodiment to experience a flying sensation.

It is also within the scope of the invention to configure a passenger assembly 115 to be riding on top of a guide structure to experience a road racing sensation.

The passenger assembly 115 includes a frame. In the embodiment shown in FIGS. 6-8 the frame has a suspension arm 115*a* which is suspended from the carriage 110. The frame further has a central frame structure 115*b*.

On the topside of the central frame structure a chest support 120 is mounted in a stationary position, such that the passenger can rest the front of this trunk on the chest support 120. In this example the chest support 120 is U-shaped so as to have side flaps 120*a* at opposite sides of the trunk. Further, in the shown embodiment of a chest support 120, upper leg retention members 131 are formed integral with the chest support 120. The two upper leg retention members 131 are arranged on two sides of the central frame structure 115*b*. Thus, the upper leg retention members 131 are arranged stationary together with the chest support 120, while in the shown embodiment a portion of the central frame structure 115*b* extends between the legs of the passenger.

Rearward of the chest support 120 the central frame structure 115*b* is provided with a saddle 121, upon which the passenger can be seated. In the shown embodiment, the saddle 121 is mounted movable on the central frame structure 115*b*. The saddle 121 is movable between a more rearward position, shown in FIG. 6, and a more forward racing position, shown in FIGS. 7 and 8. A passenger boarding the passenger assembly 115 engages with the saddle 121 and sits on it. The passenger should move the saddle forward to the racing position shown in FIG. 7 to allow the passenger's trunk to rest with its chest side on the chest support 120 and place the upper leg against the upper leg retention members 131. In the shown embodiment, this moving forward automatically occurs as a result of gravity, as the saddle 121 is positioned higher in the more rearward position of FIG. 6 and lower in the racing position of FIGS. 7 and 8. A spring (not shown) may be provided to position the saddle 121 in the more rearward position of FIG. 6 when no passenger is seated on the saddle 121. Such a moveable saddle 121 may be preferred to stimulate passengers to position the front of this trunk on the chest support 120 and to engage his legs with the leg retention members.

The shown saddle 121 comprises an elevated portion 121*a*, against which a portion of the stomach of a passenger rests. As such, the saddle 121 also gives some trunk support.

Behind the saddle 121*a* back restraining member 122 is provided to restrain motion of the passenger away from the chest support 120. In the shown embodiment, the back restraining member 122 is mounted pivotable on central frame structure 115*b* via a pivot 122*c*. The back restraining member is pivotable between an access position shown in FIG. 6, allowing the passenger, at the boarding station, to place his chest on the chest support 120, and a restraining position, shown in FIG. 7, wherein the passengers trunk is restrained.

Back restraining member 122 comprises a padded portion 122*a* which engages with the back of the passenger, which is preferably connected pivotably to a back restraining member frame portion 122*b* to allow optimum support against the back of any type of passenger.

In front of the chest support 120 a handlebar assembly 117 is provided, which is pivotable with respect to the central frame structure 115*b*. The passenger can grip the handlebar assembly 117 with both hands, and allows the passenger to rest his underarms on top of the handlebar assembly 117. The shown handlebar assembly 117 is pivotable about a pivot axis (117*a*) between an access position shown in FIG. 6 and the racing position shown in FIGS. 7 and 8.

Preferably, the handlebar assembly 117 actuates the back restraining member 122, e.g. via a mechanical transmission. In the shown embodiment, upon pivoting the handlebar assembly 117 towards the passenger when gripping the handlebar assembly 117, the back restraining member 122 is also allowed to pivot from the access position shown in FIG. 6 to the restraining position, shown in FIG. 7, wherein the passenger's trunk is restrained.

In the design shown in FIGS. 6-8 the leg restraining device comprises upper leg retention members 131 formed integral with the chest support 120 and lower leg retention members 132 which are connected pivotable about a pivot axis 132*a* to the central frame structure 115*b*. The pivot axis 132*a* is provided intermediate the lower leg retention member 132, dividing the lower leg retention members 132 in an upper portion 132*b* and a lower portion 132*c*, both of which are padded portions. Between upper portion 132*b* and lower portion 132*c* a step 140 is provided, which step is accessible in a substantially vertical access position shown in FIG. 6. Preferably, a spring (not shown) is provided to position the pivotable lower leg retention member 132 in the substantially vertical access position of FIG. 6.

The connection of the pivot axis 132*a* to the frame 115*b* is arranged below and behind the position of the knee in the racing position, such that the passenger upon boarding places the upper leg against the upper leg retention member 131, engages with the lower leg retention members 132 and should bend his legs at the knee and pivot the pivotable lower leg retention members 132 to the racing position. This arrangement of the lower leg retention members is such that when the passenger is accommodated with its chest against the chest support 120, each leg is oriented such that the upper leg is angled downward with respect to the trunk and the leg is bent at ht knee so that the lower leg is angles rearward with respect to the upper leg.

Each leg restraining device further includes a mobile knee restraining member 135 which is pivotable about pivot axis 135*a* between an access position shown in FIG. 6 allowing the passenger to place his upper leg in the upper leg restraint member 131 and his lower leg in the lower leg restraint member 132 and to perform the pivoting movement of the lower leg restraint member 132, and a restraining position shown in FIG. 7 wherein the knee restraining member 135 is positioned at the backside of the knee so that the knee restraining member 135 prevents the passenger from removing the leg from the upper and lower leg retention members 131, 132. In the shown embodiment, the knee restraining member 135 is actuated by the handlebar assembly 117, which in this embodiment also actuates the back restraining member 122, e.g. via a mechanical transmission. Thus, upon pivoting the handlebar assembly 117 towards the passenger when gripping the handlebar assembly 117, both the back restraining member 122 and the knee restraining member 135 are allowed to pivot from the access position shown in FIG. 6 to the restraining position, shown in FIGS. 7 and 8, wherein the passenger's knee and back are restrained.

The invention claimed is:

1. A rollercoaster amusement device, comprising:

an endless guide structure at least comprising multiple curves, one or more carriages displaceable along said guide structure, a passenger assembly associated with a carriage, said passenger assembly being adapted to accommodate at least one passenger, and a station along said guide structure allowing the passenger to board the passenger assembly, wherein the passenger assembly includes a frame that is connected to the carriage, the frame at least being provided with:

a chest support, a back restraining member, and a leg restraining device for each leg, such that:

the passenger's trunk can rest with a chest side thereof on the chest support, the back restraining member can restrain motion of the passenger away from the chest support, and the leg restraining devices can each hold the respective leg such that the upper leg is angled downward with respect to the trunk and the leg is bent at the knee so that the lower leg is angled rearward with respect to the upper leg, wherein the leg restraining device for restraining a leg includes:

an upper leg retention member adapted to engage at least the front side of the upper leg, a lower leg retention member adapted to engage at least the front side of the lower leg, so that the upper and lower leg retention members can retain the leg while bent at the knee, and wherein the upper leg retention members are arranged substantially stationary on the frame and the lower leg retention members are connected to the frame such that upon boarding the passenger assembly the passenger should bend his legs at the knee and place the upper and lower leg against the upper and lower leg retention members, and wherein the leg restraining device further includes:

a mobile knee restraining member and an associated knee restraining member drive for driving the knee restraining member, wherein the knee restraining member is mobile between an access position, allowing the passenger, at the boarding station, to place his upper and lower legs against the upper and lower leg retention members, and a restraining position wherein the knee restraining member is positioned at the backside of the knee so that the knee restraining member can prevent the passenger from removing the leg from the upper and lower leg retention members.

2. The rollercoaster amusement device according to claim 1, wherein at least one lower leg retention member is arranged substantially stationary on the frame.

3. The rollercoaster amusement device according to claim 1, wherein at least one lower leg retention member is connected pivotable about a pivot axis to the frame, which pivot axis is provided intermediate the lower leg retention member, dividing the lower leg retention member in an upper portion and a lower portion, and wherein the connection of the pivot axis to the frame is arranged below and behind the position of the knee, such that the passenger upon boarding can place the upper leg against the upper leg retention member, can engage with the lower leg retention members and should bend his legs at the knee and pivot the pivotable lower leg retention member.

4. The rollercoaster amusement device according to claim 3, wherein a spring is provided positioning the pivotable lower leg retention member in a substantially vertical access position.

5. The rollercoaster amusement device according to claim 3, wherein the pivotable lower leg retention member comprises at least two padded portions between which at least one step is provided, which step is accessible in a substantially vertical access position.

6. The rollercoaster amusement device according to claim 1, wherein the upper leg retention members are formed integral with the chest support.

7. The rollercoaster amusement device according to claim 1, wherein the chest support is arranged substantially stationary on the frame, and wherein the back restraining member is mobile with respect to the frame between an access position—allowing the passenger, at the boarding station, to place his chest on the chest support—, and a restraining position, wherein the passenger's trunk can be restrained.

8. The rollercoaster amusement device according to claim 1, wherein the chest support is arranged in an orientation which lies between a position parallel to the guide structure and an upward inclined position of at most 40 degrees.

9. The rollercoaster amusement device according to claim 1, wherein the upper leg can be held in an orientation substantially at right angles to the guide structure between 20 degrees forward and rearward with respect to the normal to the guide structure.

10. The rollercoaster amusement device according to claim 1, wherein the lower leg can be held in an orientation substantially parallel to the guide structure between 20 degrees upward and downward with respect to the guide structure.

11. The rollercoaster amusement device according to claim 1, wherein passenger assembly has no headrest, such that the passenger is free to move its head in any direction.

12. The rollercoaster amusement device according to claim 1, wherein the back restraining member is adapted to engage on the back so as to leave the shoulder portion of the passenger free, thus allowing the passenger to move by raising its shoulder portion.

13. The rollercoaster amusement device according to claim 1, wherein the passenger assembly includes a central frame structure, the upper and lower leg retention members for each leg being mounted on opposite sides of the central frame structure, and the knee restraining members being mounted movable on said central frame structure.

14. The rollercoaster amusement device according to claim 13, wherein the upper and/or lower leg retention member(s) each are L-shaped having an inner end connected to a central frame structure of the passenger assembly, and each having a front section adapted to extend across the front of the respective leg part and each having an outer side section adapted to extend along the side of the respective leg part.

15. The rollercoaster amusement device according to claim 14, wherein the knee restraining member is L-shaped having an inner end connected to the central frame structure of the passenger assembly, and having a transverse section adapted to extend in transverse direction along the backside of the knee, and having an outer side section adapted to extend along the outside of the knee.

16. The rollercoaster amusement device according to claim 1, wherein the passenger assembly is adapted for accommodation of two passengers in side-by-side arrangement.

17. The rollercoaster amusement device according to claim 7, wherein the passenger assembly is adapted for accommodation of two passengers in side-by-side arrangement, wherein the frame includes an arm extending between the passengers, and wherein each back restraining member is mounted movable on the arm.

18. The rollercoaster amusement device according to claim 1, wherein the frame of said passenger assembly includes a suspension arm which is suspended from said carriage by means of a pivot, said pivot having a pivot axis essentially in longitudinal direction of the guide structure, such said assembly will swing in pendulum fashion as the carriage passes through a curve of the guide structure.

19. The rollercoaster amusement device according to claim 18, wherein the passenger assembly is adapted to accommodate two passengers in a side-by-side arrangement, each passenger on an opposite side of the suspension arm.

20. The rollercoaster amusement device according to claim 1, wherein the passenger assembly is adapted to accommodate two passengers in a side-by-side arrangement, and wherein the frame of the passenger assembly has a suspension arm which is suspended from said carriage, and wherein the passenger assembly further has lateral spreader beams mounted on said suspension arm and each extending laterally from said suspension arm in opposite directions, each lateral spreader beam supporting a central frame structure provided with a chest support and upper and lower leg supports, the upper and lower leg supports being mounted on opposite sides of the central frame structure, the knee restraining members being mounted movable on said central frame structure.

21. The rollercoaster amusement device according to claim 20, wherein the suspension arm is connected to said carriage by a pivot having a pivot axis essentially in longitudinal direction of the guide structure, such that said passenger assembly will swing in pendulum fashion as the carriage passes through a curve of the guide structure.

22. The rollercoaster amusement device according to claim 20, wherein each back restraining member is movable mounted on the suspension arm.

23. The rollercoaster amusement device according to claim 1, wherein the passenger assembly further includes a saddle on which the passenger can be seated upon boarding the rollercoaster amusement device.

24. The rollercoaster amusement device according to claim 23, which saddle is mounted movable on the frame between a more rearward position and a more forward position.

25. The rollercoaster amusement device according to claim 24, wherein the saddle is positioned higher in the more rearward position and lower in the forward position, and wherein a spring is provided to position the saddle in the more rearward position.

26. The rollercoaster amusement device according to claim 1, wherein the passenger assembly is embodied such that the passenger's feet are unrestrained.

27. The rollercoaster amusement device according to claim 1, wherein the frame is further provided with a handle bar assembly which actuates the mobile knee restraining member and/or the back restraining member.

28. The rollercoaster amusement device according to claim 1, wherein a platform is mounted at the rear end of the central frame structure allowing the passenger to stand on said platform during boarding and disembarking from the amusement device.

29. The rollercoaster amusement device according to claim 1, wherein the guide structure has two parallel rails and each carriage has a frame provided with two wheel sets each engaging a rail of the guide structure, wherein the carriage has a longitudinal member extending rearwards along the guide structure and having a coupling for coupling to another such carriage.

30. A rollercoaster amusement device, comprising:

an endless guide structure at least comprising multiple curves, a station along said guide structure allowing passengers to board the rollercoaster amusement device, a carriage displaceable along said guide structure, and a passenger assembly associated with said carriage, said passenger assembly being adapted to accommodate at least one passenger, which passenger assembly has a frame which is at least provided with a chest support, a back restraining member, and a leg restraining device for each leg, such that:

the passengers trunk can rest with a chest side thereof on top of the chest support, the back restraining member can restrain motion of the passenger away from the chest support, and the leg restraining device can hold each leg such that the upper leg is angled downward with respect to the trunk and the lower leg is angled rearward with respect to the upper leg, wherein the passenger assembly is adapted to accommodate two passengers in a side-by-side arrangement, and wherein the passenger assembly has a suspension arm which is suspended underneath said carriage, and wherein the passenger assembly further has lateral spreader beams mounted on said suspension arm and each extending laterally from said suspension arm in opposite directions, each lateral spreader beam supporting a central frame structure provided with the chest support and leg restraining devices, and wherein the lateral spreader beams are located underneath said carriage when the passenger is in an upright position.

31. The rollercoaster amusement device according to claim 30, wherein the suspension arm is connected to said carriage by a pivot having a pivot axis essentially in a longitudinal direction of the guide structure, such that said assembly will swing in pendulum fashion as the carriage passes through a curve of the guide structure.

32. The rollercoaster amusement device according to claim 30, wherein each back restraining member is movably mounted on the suspension arm.

33. The rollercoaster amusement device according to claim 30, wherein said suspension arm, lateral spreader beams and central frame structures form a rigid constructional member.

34. The rollercoaster amusement device according to claim 33, wherein the upper and lower leg retention members are mounted stationary on each central frame structure.

35. The rollercoaster amusement device according to claim 30, wherein a saddle is mounted on the central frame structure rearward of the chest support.

36. The rollercoaster amusement device according to claim 30, wherein a platform is mounted at the rear end of the central frame structure allowing the passenger to stand on said platform during boarding and disembarking from the amusement device.

37. The rollercoaster amusement device according to claim 30, wherein the guide structure has two parallel rails and each carriage has a frame provided with two wheel sets each engaging a rail of the guide structure, wherein the carriage has a longitudinal member extending rearwards along the guide structure and having a coupling for coupling to another such carriage.

* * * * *